United States Patent [19]

Vaseen

[11] 4,261,711

[45] Apr. 14, 1981

[54] MAGNETIC SEPARATION APPARATUS

[76] Inventor: Vesper A. Vaseen, 9840 W. 35th Ave., Wheat Ridge, Colo. 80033

[21] Appl. No.: 44,962

[22] Filed: Jun. 4, 1979

[51] Int. Cl.[3] ..... B03C 1/02

[52] U.S. Cl. ..... 55/100; 55/201; 55/206; 210/222; 261/122

[58] Field of Search ..... 55/3, 100, 46, 52, 201, 55/206; 210/222; 261/122

[56] References Cited

U.S. PATENT DOCUMENTS

| | | | |
|---|---|---|---|
| 979,211 | 12/1910 | Serrell | 261/122 X |
| 1,389,101 | 8/1921 | Ohrvall | 55/206 X |
| 3,003,580 | 10/1961 | Lanning | 55/46 |
| 3,054,602 | 9/1962 | Proudman | 261/122 X |
| 3,216,951 | 11/1965 | Erickson et al. | 261/122 X |
| 3,761,852 | 9/1973 | Albrecht | 55/206 X |
| 4,049,398 | 9/1977 | Vaseen | 55/3 |

FOREIGN PATENT DOCUMENTS

| | | | |
|---|---|---|---|
| 1910574 | 9/1970 | Fed. Rep. of Germany | 55/100 |
| 2056260 | 5/1972 | Fed. Rep. of Germany | 55/100 |

*Primary Examiner*—Kathleen J. Prunner

[57] ABSTRACT

The apparatus described in this disclosure has only one principal function, that is, to mechanically separate an inert, dielectric, nonmagnetic, liquid carrying absorbed paramagnetic gases; into two phases, that which becomes saturated or supersaturated with absorbed paramagnetic gases and that which has been magnetically stripped of its absorbed paramagnetic gases. The apparatus works only within the space between a pair of north and south poles of a high intensity magnet. The magnetic forces attract the paramagnetic gases to the poles, the mechanical apparatus, here disclosed, isolates separate streams of the liquid into selected concentrated absorbed gases streams. When the concentration of the absorbed paramagnetic gases becomes supersaturated to the extent the gases effervesce from the liquid, the apparatus collects the gases for use or further processing.

1 Claim, 5 Drawing Figures

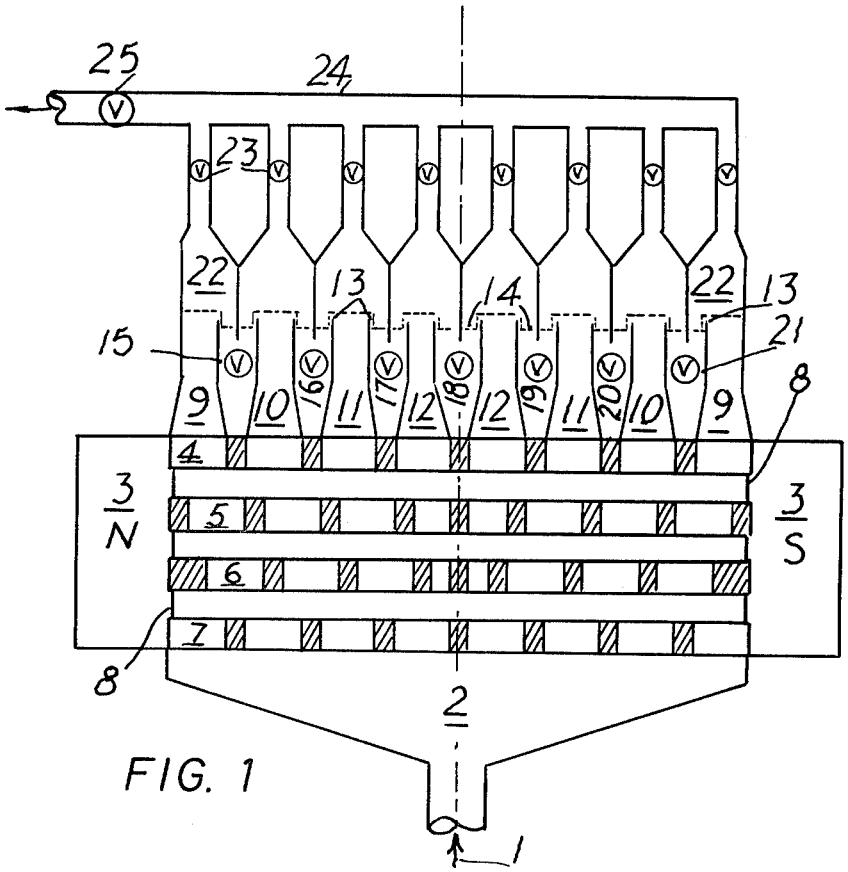
FIG. 1
FIG. 2
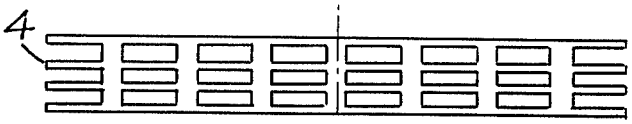
FIG. 3
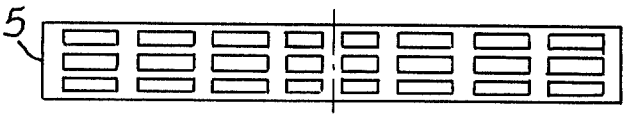
FIG. 4
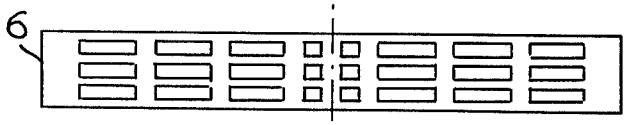
FIG. 5
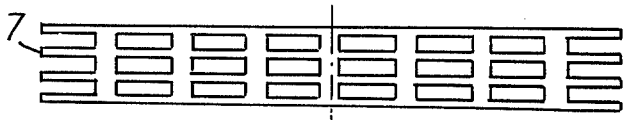

MAGNETIC SEPARATION APPARATUS

BACKGROUND OF THE INVENTION

Many attempts to magnetically collect paramagnetic gases from a mixture of paramagnetic and nonmagnetic gases have been made. The processes and apparatus for accomplishing these attempts have been numerous. It was not until it was disclosed by Vaseen, U.S. Pat. No. 4,049,398, that paramagnetic gases could be concentrated and/or purified by being absorbed in an inert, nonmagnetic, dielectric liquid and then by magnetic attraction, concentrating the paramagnetic gases in the liquid while at or near the poles of a high intensity magnet to an extent that the supersaturated gas is effervesced or released from the liquid, which is then collected as product.

The process of accomplishing the above to be commercially usable requires an apparatus wherein the process can be controlled and the paramagnetic gases efficiently collected. The disclosure hereafter teaches the art and science of constructing said apparatus.

DESCRIPTION OF PRIOR ART

Prior art for concentrating paramagnetic gases has consisted entirely of apparatus for enrichment of the desired gas in the same gas stream, but, never as a pure gas not a part of the original gas stream; or from a nonmagnetic liquid.

Various U.S. and foreign patents describe these processes or apparatus.

No prior art is known to exist for the apparatus disclosed in detail herein in my invention.

BRIEF SUMMARY OF INVENTION

Thirty two elements form compounds which exhibit paramagnetic characteristics and 16 elements are paramagnetic in pure form. The compounds and elements which are paramagnetic when in a gaseous state are soluble in many inert, nonmagnetic, dielectric liquids and from these liquids are collectable by magnetic attraction to high intensity magnet poles. The apparatus which accomplishes this phenomenon is the invention herewith disclosed. The apparatus consists of a sandwich of porous plates with specifically located openings. The location of the openings causes a liquid with absorbed gases to move through the space between the poles of a high intensity magnet, progressively allowing the migration of the paramagnetic gases in the liquid to supersaturate the liquid at or near the poles, and thus be collected as either effervesced gas from the liquid or supersaturated liquid.

FIG. 1 is a schematic cross-sectional view of an apparatus according to the present invention; and FIGS. 2 to 5 are top plan views of the plates used in the apparatus of FIG. 1.

DETAILED DESCRIPTION OF INVENTION

Some process patents for magnetically removing from an inert, dielectric, nonmagnetic liquid paramagnetic susceptible gases absorbed or dissolved in the liquid are: oxygen production from air, U.S. Pat. No. 4,049,398, Sept. 20, 1977 Ozone via liquid dielectric, U.S. Pat No. 4,140,608, Feb. 20, 1979; Producing Nitric acid via liquid dielectric, U.S. Pat. No. 4,139,595, Feb. 13, 1979; Producing Sulphuric acid via liquid dielectric, U.S. Pat. No. 4,139,596, Feb. 13, 1979; Paramagnetic $NO_x$, U.S. Pat. No. 4,142,874, March 6, 1979; Medical oxygen via paramagnetic $O_2$, U.S. Pat. No. 4,150,956, April 24, 1979.

The apparatus for controlling these processes consists of placing between the north and south poles (3) of a high intensity magnet a sandwich of perforated plates (4-7), preferably nonmagnetic and of dielectric material, which are separated by spacers (8) from each other by a distance, preferably, the same as the thickness of the individual plates in the sandwich. The perforations can be square, rectangular, oval, round, triangular, or any other shape or combinations thereof. The perforations of one plate are, preferably, not aligned vertically with those of the next plate above or below it. The perforations are preferably aligned so as to produce a direction of flow through the space between the poles of the magnet which will move the inert, dielectric, nonmagnetic liquid, pregnant with paramagnetic and nonparamagnetic gases from the centerline of the distance between the poles toward either the north or south pole. For example, gases pregnant liquid introduced at (1) to the apparatus is first velocity controlled in a distribution well or reservoir (2) which is designed to cause a streamline flow of the liquid through sandwich plate (7). The high intensity paramagnetic forces across sandwich plate (7) attract the paramagnetic absorbed gases to both the north and south poles, according to which side the paramagnetic atoms molecules started through. The space or divider between sandwich plates (6) and (7) permits noninterfered motion of these magnetically attracted paramagnetic gases toward their respective poles. The offset relationship of the perforations between the sandwich plates (4–7) contains the migration of the paramagnetic gases through the magnetic poles. Although by way of illustration only four sandwich plates have been illustrated, an infinite number is theoretically possible. The staggering of the perforations is also, by way of illustration, shown as being accomplished by the use of three plates having differently arranged perforations but an infinite number of such plates is possible. Those familiar with the art and science of moving a fluid through a series of perforations (or parallel series of small tubes) will have no difficulty in designing the number of perforations, the shape of the perforations, the number of sandwich plates, and their respective spacing which will control the rate of flow and quantity of flow of the liquid through the space between the magnetic poles per unit of time.

The apparatus is furnished with a fluid overflow device, preferably, consisting of collection boxes (9)(10)(11) and (12) with overflow weirs (13). The over flow weirs (13) spill the liquid to collection troughs from whence discharge orifices and control valves (15)(16)(17)(18)(19)(20) and (21) control the rate of flow out of the apparatus as well as make it possible to control the collection of the overflows from (9) by valves (15) and (21) as isolated flows from the balance of the liquid; or the outermost collection boxes from the two outermost collection boxes (9) and (10) by valves (15), (16), (20) and (21); and continuing to include controlled collection of the overflows from all the collection boxes if desired. An operating level (14) of nonmagnetic liquid is maintained so that only magnetic gas stripped liquid is discharged from orifices (15–21). The purpose in providing for collection of each overflow from (9) or from both (9) and (10), etc. is to enable paramagnetic gases saturated liquid to be separated from the paramagnetic gases stripped liquid; normally at the center collection boxes such as (12), or (11) and (12).

If the object of the collection of paramagnetic gases is as a gas(s) the rates of flows through the apparatus from (1) to (15)-(21), is restricted to allow supersaturation of the liquid at the collection box (9); with the effervesced gas evolved in the collection hood (22) thence removed through flow and pressure control valve(s) (23) to the gas collection manifold (24); thence discharged through rate of flow and pressure control valve (25) to storage or use. A rate of flow of the liquid through the apparatus when very slow thus permits gas evolvement at not only (9), but also even (11) and (12). Since the rate of evolved gas and the quantity is greatest at the outside boxes (9), control for balance of gas withdrawal is by adjustment of valves (23).

If the object of the collection of paramagnetic gases is as a saturated gas in the liquid then the rate of flow of the liquid is controlled which saturates the liquid at collection box (9), or both (9) and (10), or even (11), but doesn't permit supersaturation and thus evolved effervescent gas. Should some gas be evolved it is recycled back to the influent flow (1) for salvage. The separation of effluent streams of the liquid then provide for saturated paramagnetic gas liquid removal from troughs controlled by orifices and control valves (15) and (21), or such as (15), (16), (20) and (21), depending on the degree of gases saturation the interior liquid possesses.

Temperature of the apparatus is preferably controlled by absorption of high intensity magnet produced heat by the specific heat capacity of the liquid. Should the design of a particular system cause an unacceptable rise in liquid temperature, exterior magnet cooling is done (not shown). This is accomplished, preferably, by circulating around the magnet poles a heat exchanger fluid.

Thus it is disclosed how the art and science of paramagnetic gases removal from an inert nonmagnetic dielectric liquid by high intensity magnet(s) is mechanically accomplished. Although certain shapes, configurations, and apparatus parts are coordinated to accomplish the purpose of the apparatus, this had been by way of illustration and does not preclude those other shapes, configurations, and composites of parts of the apparatus which accomplish the same purpose.

PREFERRED EMBODIMENT

Example No. 1

It is the intention of this invention to teach the art and science of designing an apparatus which mechanically separates paramagnetic gases from an inert, dielectric, nonmagnetic liquid or separates a part of the liquid flow which has been made saturated with paramagnetic gases; both by use of a high intensity magnetic force across the poles of the magnet through which is caused to flow the liquid pregnant with absorbed gases of both paramagnetic as well as nonparamagnetic characteristics.

The illustration herewith is for the design of a portable apparatus which processes liquid which has absorbed air, which will produce two grams of pure medical grade oxygen per minute.

Although this example describes the entire process of producing 2 grams of pure oxygen per minute, it is only the interest of this invention to design the apparatus and not the process which will produce the oxygen from a liquid stream saturated with sterile, particulate free air.

Air is supplied to the entire apparatus at preferably 21° C.±2° C. at a rate which will deliver to the patient 2±0.5 grams of oxygen per minute. Since air has a greater solubility in a liquid when in a pressurized system (preferably the air is absorbed after being purified of less than 5 micron particles, and sterilized), it is absorbed preferably at ten atmospheres. The filtered, sterilized air is then absorbed in the absorber liquid in an absorber vessel.

The absorber liquid is selected from the family of silicone liquids (polyorganosiloxanes), or the family of halogenated hydrocarbons, specially the halogen saturated compounds with one or more fluorine atoms.

The absorber liquid selected is one which meets the following general specifications:

1. Boiling point several times that of water.
2. Specific gravity either greater or less than water (for easy separation).
3. Practically non volatile.
4. Critical temperature—several times that of water.
5. Nonmiscible with water.
6. Non toxic to bio-organisms.
7. Stable physical and chemical characteristics at ambient as well as elevated temperatures, such as 315° C.
8. Stable physical and chemical characteristics at atmospheric as well as superatmospheric pressures, such as (40) forty atmospheres.
9. Nonbiodegradable
10. Nonoxidizable with ozone
11. A Dielectric
12. Nonmagnetic
13. An affinity for absorbing gases
14. Nonflammable
15. Reusable The liquid is caused to absorb the air under a positive pressure and preferably retained under the same pressure through the oxygen separation apparatus. The liquid, following paramagnetic supersaturation and removal of the oxygen by effervescence, is reduced to ambient or subatmospheric pressure which strips it of absorbed nitrogen gas.

Air at 24° C. contains 0.28 grams of oxygen per each liter of air at atmospheric pressure. Air is supplied to the absorber, preferably, at a rate of 7 liters per minute at 24° C. and at atmospheric pressure.

Selection of a polyorganosiloxane such as $(CH_3)_3SI\text{-}O((CH_3)_2SIO)_xSI(CH_3)_3$ satisfies the chemical physical characteristics and provides for absorption of air to also provide up to 3 grams of oxygen per liter of liquid used.

The effervescence of pure oxygen gas is achieved by moving through the high intensity magnet separation apparatus one liter of the selected liquid per each minute of time. The magnetic attraction of the paramagnetic gases is instantaneous, except the liquid inhibits the migration rate of the atoms and molecules to the pole as well as out of the liquid by effervescence. A time period for retention of the liquid between the poles is determined by laboratory examination of the specific liquid selected, for example twelve seconds, along with its selected temperature and pressure of operation which will both supersaturate the liquid at the poles and produce an effervescence of for example 2 grams of oxygen per minute. A flow rate through the magnet separation apparatus is thus determined to be 200 c.c. of liquid. Selection of a volume configuration of 15 c.c. between the faces of the magnet poles, then indicates a width of 5 c.c. and a depth of 10 c.c.; based on a void space provided by the perforations and spaces between the sandwich plates (4)(5)(6) and (7) of for example eighty percent.

The small quantity of liquid and small quantity of oxygen with the resultant small apparatus dimensions make it unnecessary to provide for other than the overflow of paramagnetic gas supersaturated liquid at (9) with liquid effluent collection trough and control orifices and valves (15) and (21). Since pure oxygen gas is the object of the apparatus all overflow liquid is thus removed from the apparatus by orifices and control valves (15) and (21). The apparatus would have but two gas collection hoods at each pole.

The paramagnetic gas stripped liquid collected from the overflow weirs at collection box (9) as well as from (12) (the only other liquid overflow required in this small system), is discharged from the apparatus through orifice and control valves (15) and (21) (also the only controls required in this small system) to a point of atmospheric or subatmospheric pressure wherein the absorbed nitrogen gas is stripped and the liquid made ready for recycle. The processing of the liquid both prior to the influent to this apparatus, and subsequent to the effluent leaving via orifices and control valves (15) to (21) is not a part of this invention.

EXAMPLE NO. 2

The illustration herewith is to teach the design of a stationary apparatus which processes liquid which has absorbed air for the purpose of concentrating the paramagnetic oxygen absorbed therein in a side stream of liquid almost at or just at supersaturation. The purpose for concentrating the oxygen in the liquid, for further processing, in an ozonator, using the liquid as the dielectric, is in order to convert the absorbed oxygen to absorbed ozone. The illustration herewith is concerned only with the mechanics of the apparatus to enable the processing to be accomplished, and makes no claim to processes.

The absorber liquid selected is one which meets the same specifications as listed for Example No. 1.

The liquid is caused to absorb air under a positive pressure and preferably retained under the same pressure throughout the concentration of oxygen in a side stream of the liquid, through the apparatus. The liquid remaining from the side stream containing the concentrated oxygen is, following removal from the apparatus, reduced to atmospheric or subatmospheric pressure to permit stripping of the nitrogen gas and then recylced.

For example to produce (10%) ten percent ozone ($O_3$) mixed with (90%) ninety percent oxygen, both as absorbed gases in an inert liquid, an oxygen supply is established with a capacity, for example, of 168 grams per hour, when producing 16.8 grams per hour of pure ozone.

Air at 24° C. and one atmosphere is absorbed in a halogenated hydrocarbon type liquid containing 8 or more carbon atoms at the rate of 43.2 liters per minute when recirculating 8.33 liters of the inert, dielectric, non magnetic liquid through the apparatus each minute. A halogenated hydrocarbon is preferably selected, rather than a polyorganosiloxane, in order to provide a liquid non reactive to ozone. The oxygen absorbed in the liquid is 2.8 grams per minute, and the nitrogen absorbed in the liquid is 9.3 grams per minute. The object of the apparatus is this example is to make 0.28 grams of pure ozone per minute. Following the apparatus of this invention is a process and apparatus wherein the 2.8 grams of absorbed oxygen in a greatly reduced nitrogen content absorber liquid is excited by radiant energy to (10%) ten percent ozone and (90%) ninety percent, oxygen.

The 8.33 liters of inert, dielectric, non magnetic liquid saturated with 43.2 liters of air and containing 2.8 grams of oxygen and 9.3 grams of nitrogen is under absorber reactor pressure, for example ten atmospheres and 24° C., and passed through the apparatus of this invention, first by filling the apparatus by injecting the air saturated liquid into the paramagnetic oxygen concentrating apparatus. A rate of flow is then established to retain the liquid in the apparatus, saturate the overflow liquid from collection box (9), and effect effervescence and collection of pure oxygen gas in hood (22).

In order to retain the absorber liquid between the poles of the magnet, for example for six seconds, with the dimensions of the magnet as per this example, it is necessary to design the sandwich of plates wherein the voids which fill with the liquid comprises 80% of the total volume. The example herewith alludes to a magnet having poles of 10×10 cm in area placed 10 cm from face to face.

The degree of oxygen saturation of the overflow liquid from each collection box (9), (10), (11) and (12) is tested and the overflow liquid accepted as satisfactory for introduction to any further process, such as ozonation, with only those orifices and control valves, for example (15) and (16), isolated to this purpose. The balance of the overflow liquid, stripped paramagnetically of the oxygen, for example, is removed via orifice and control valves (17) and (18) to atmospheric or subatmospheric pressure and thus stripped of its absorbed nitrogen gas, then returned to recycle use.

Oxygen gas evolved at the gas collection hoods (22) above the overflow weirs is removed by adjusting balancing valves (23) to discharge the rate of gas evolved at each hood and removed through manifold (24) by means of flow and pressure control valve (25). Oxygen removed in this manner is returned to the absorber for recycle or mixed with the oxygen saturated liquid being sent to further processing such as an ozonator.

The examples heretofore teach the art and science of design of an apparatus for either generation of a paramagnetic gas or saturation of the liquid with a concentration of the paramagnetic gas. The rates of flow and quantities used along with dimensions are intended for illustration only, as such are specific to the kind of paramagnetic gas, physical characteristics of the absorber liquid, the temperature and pressure parameters selected along with magnetic forces and generated heat removal methods.

Thus is the art and science of the design of the apparatus disclosed and taught. Those versed in the field of electromagnetics and non magnetic liquids, will have no difficulty designing adaptations to the examples illustrated.

While the apparatus has been described in a certain degree of particularity, it is understood that the disclosures have been made by way of example and that changes in detail of structures may be made without departing from the spirit thereof.

What is claimed is:

1. Apparatus for the separation of paramagnetic gases absorbed in an inert, dielectric, non-magnetic liquid from the non-paramagnetic gases also absorbed in the liquid or for the saturation of paramagnetic gases in such a liquid, comprising:

a high intensity magnet having its north and south poles spaced from one another;

an influent system for the inert, dielectric, non-magnetic liquid opening between the magnet poles and including a distribution well which resolves turbulent pipeline flow characteristics of the liquid into a homogenous and straight line flow through the space between both of the magnet poles;

a series of perforated, sandwiched plates disposed between and opposite the magnet poles, installed with the plates at 90° to the direction of liquid flow, and in line with the magnetic lines of force;

each plate containing perforations sufficient to permit the uninterrupted flow of the liquid without undue restriction and unnecessary friction, the perforations consisting of circles, squares, rectangles, triangles, or any other shape or combination thereof;

the perforations of each succeeding plate being staggered one downstream of the other so as to produce a controlled migration of paramagnetic atoms on each side of the center line between the poles toward their respective polarization;

each plate being separated from adjacent plates by a space providing a volume similar to the volume within the perforations of the preceding and/or succeeding plates;

the series of plates continuing throughout the liquid flow distance contained between and opposite the poles;

a series of liquid collection boxes disposed downstream of the plates so as to receive, entrap and separate the polarized liquid progressively received along the last plate of the sandwich, thus providing groups of liquid collection separations;

each collection box being provided with an overflow weir which leads to a separate liquid collection trough and liquid discharge;

each liquid discharge being connected to a flow rate control valve;

a gas collection hood in communication with each liquid collection box and overflow weir;

the skirt of each hood being submerged below the liquid level in the troughs so as to act as a seal for any gas collected under the hoods; and each gas collection hood being connected to a gas outlet via a flow and pressure control valve and thence to a common gas collection manifold provided with a flow and pressure control valve.

* * * * *